United States Patent [19]

Zogg et al.

[11] Patent Number: 4,705,103

[45] Date of Patent: Nov. 10, 1987

[54] INTERNALLY ENHANCED TUBES

[75] Inventors: Robert A. Zogg; Gerald F. Robertson, both of Manlius; Will C. Brown, Syracuse, all of N.Y.

[73] Assignee: Carrier Corporation, Syracuse, N.Y.

[21] Appl. No.: 881,436

[22] Filed: Jul. 2, 1986

[51] Int. Cl.[4] ..... F28B 1/00

[52] U.S. Cl. ..... 165/110; 165/179; 165/133; 62/506

[58] Field of Search ..... 165/133, 179, 160; 62/506, 507

[56] References Cited

U.S. PATENT DOCUMENTS 3,273,599 9/1966 Heeren ..... 165/179
4,044,797 8/1977 Fujii et al. ..... 165/133 X
4,118,944 10/1978 Lord et al. ..... 165/133 X
4,545,428 10/1985 Onishi et al. ..... 165/133
4,554,908 11/1985 Hanlet et al. ..... 165/179

FOREIGN PATENT DOCUMENTS 58088 4/1982 Japan ..... 165/133

*Primary Examiner*—Albert W. Davis, Jr.
*Assistant Examiner*—Peggy A. Neils
*Attorney, Agent, or Firm*—Robert H. Kelly

[57] ABSTRACT

An enhanced heat-transfer tube for use in a condenser of a refrigeration system, in which fine grooves having a depth equal to or less than 0.0012 inches, when the refrigerant has a mass velocity equal to or greater than 200,000 $lb_m/hr\text{-}ft^2$, improves the average heat-transfer coefficient.

2 Claims, 4 Drawing Figures

INTERNALLY ENHANCED TUBES

BACKGROUND OF THE INVENTION

The present invention relates generally to enhanced tubes for use in a heat exchanger, and, more specifically, to condenser tubes adapted to have refrigerant flowing internally within the tube and simultaneously having a cooling fluid flowing externally over the same tube, wherein the tubes have fine internal grooves. These tubes may have external fins.

Tubes having integral internal fins have been known for some time as disclosed in U.S. Pat. No. 4,118,944 assigned to the present assignee. However, these tubes generally have large pressure losses due to the height of the fins and a large lead angle between the fins and the axis of the tube.

As disclosed in U.S. Pat. No. 4,044,797 enhanced tubes having grooves with depths between 0.02 and 0.2 millimeters and a mass velocity of 30,300 $lb_m/hr\text{-}ft^2$ provides good heat-transfer, since heat-transfer rates decrease below or above this range of groove depths and pressure losses increase as flow increases. Thus, in order to obtain the high efficiency desired from an internal finned tube it was believed to be necessary to have a fin height greater than 0.02 millimeters and a relatively low mass velocity. Moreover, the typically higher pressure drops of the prior-art tubes were compensated for by an increased surface area due to the larger internal fins, but contained more material per unit length of tube, therefore increasing the cost per unit length of tube.

SUMMARY OF THE INVENTION

An enhanced tube having fine internal grooves not exceeding 0.0012 inches in depth has been developed. These internally fine grooved tubes show significant increases in local heat-transfer coefficients compared to a smooth tube during condensation of a fluid when the product of mass velocity and thermodynamic quality is relatively high. Furthermore, enhanced tubes in accordance with the principles of the present invention show little increase in pressure drop and generally no increase in material content compared to a smooth tube. Tubes using the present invention provide significantly better overall condensing performance at mass velocities above 200,000 lb $hr\text{-}ft^2$ than for smooth tubes.

Accordingly, it is an object of the present invention to provide a condensate tube having superior condensing characteristics.

Another object of the present invention is to provide condensing tubes having increased heat-transfer coefficient with no significant increase in material content per unit length of the tube.

A further object of the present invention is to provide a condensing tube with increased heat-transfer coefficient without substantially increasing the cost of the tube.

These and other objects of the present invention are attained by a novel internally enhanced tube having grooves formed in the inner wall surface of the tube, which are by far finer in size than the grooves that have been provided for the purpose of increasing the heat-transfer coefficient of condensing tubes in general. The depth of the grooves generally does not exceed 0.0012 inches and a mass velocity of the condensing fluid is generally greater than 200,000 and $lb_m/hr\text{-}ft^2$.

The various features of novelty which characterize the invention are pointed out with particularity in the claims annexed to and forming a part of this specification. For a better understanding of the invention, its operating advantages and specific objects obtained by its use, reference should be had to the accompanying drawings and descriptive matter in which there is illustrated and described a preferred embodiment of the invention.

BRIEF DESCRIPTION OF THE DRAWINGS

Other objects of the present invention will be apparent from the following detailed description in conjunction with the accompanying drawings, forming a part of this specification, and in which reference numerals shown in the drawings designate like or corresponding parts throughout the same, and in which.

DESCRIPTION OF THE PREFERERD EMBODIMENT

Figure 4:
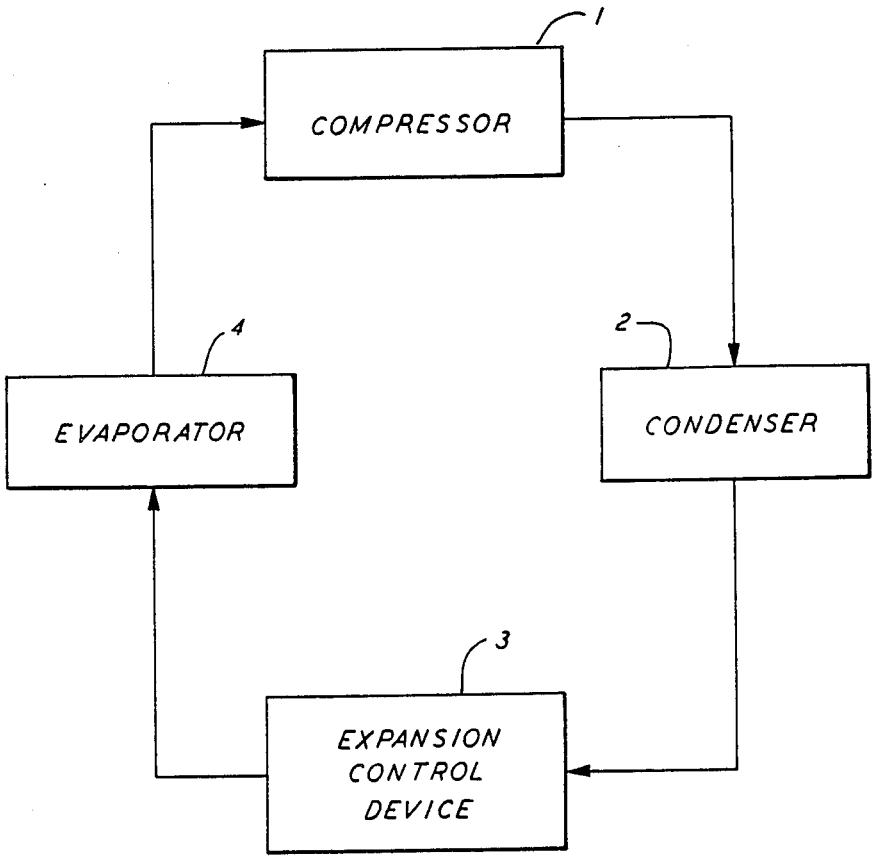
FIG. 4 is a schematic representation of a conventional direct expansion vapor compressing refrigeration system employing the present invention.

The embodiment of the invention described below is adapted for use in a condensing heat exchanger although it is to be understood that the invention finds like applicability in other forms of heat exchangers which use internally finned tubes. Condensing heat exchangers are generally used in conventional direct expansion vapor compression refrigeration systems. In such a system, as illustrqted in FIG. 4, the compressor 1 compresses gaseous refrigerant, often R-22, which is then circulated through the condenser 2 where it is cooled and liquified and then through an expansion control device 3 to the low pressure side of the system where it is evaporated within a heat exchanger or evaporator 4 as it absorbs heat from the fluid to be cooled changing phase from a partial liquid and partial vapor to a superheated vapor. The superheated vapor flows to the compressor to complete the cycle.

Figure 1:
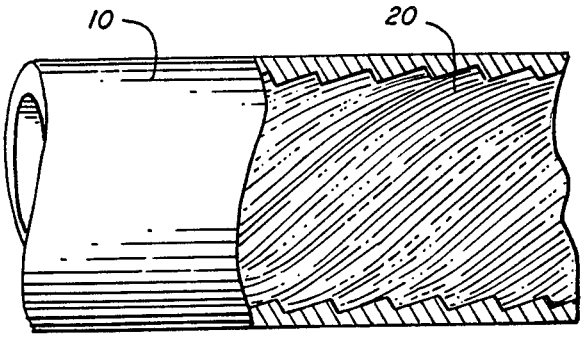
FIG. 1 is a cutaway elevational view of an internally enhanced tube of the present invention.

Referring now to the drawings, FIG. 1 shows a cutaway view of an internally grooved tube 10 such as would be used in condenser 2 according to the teachings of the present invention. As can be seen therein the grooves 20 are formed on the interior surface of the tube generally at an angle between the direction of the grooves and the longitudinal axis of the tube. However, axially grooved tubes can also be used.

Figure 2:
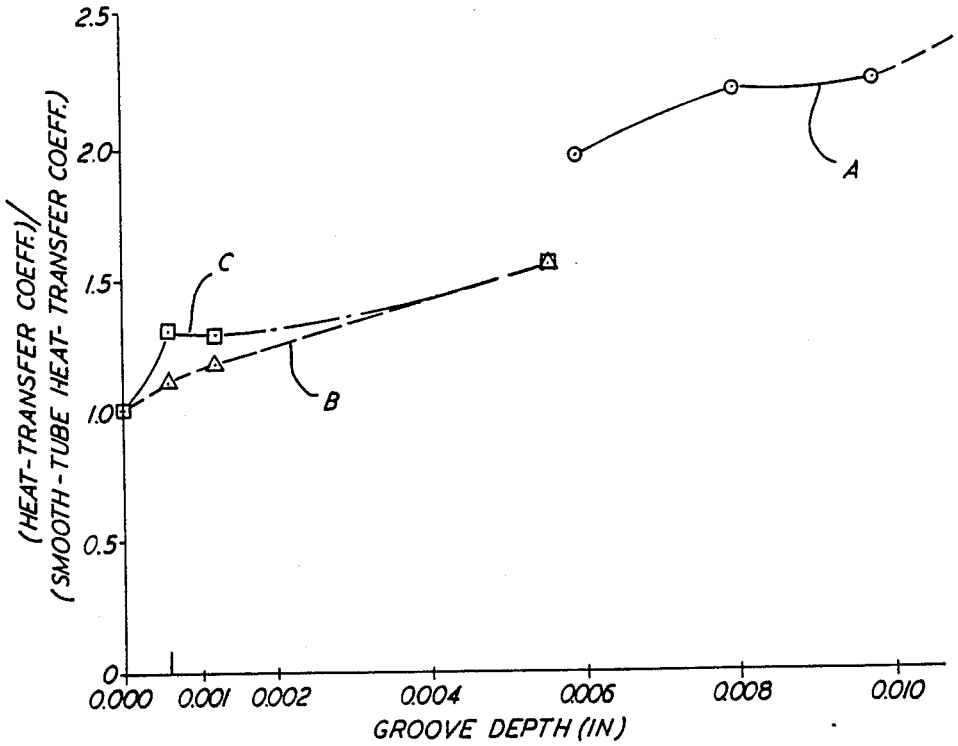
FIG. 2 is a graph showing the relationship between groove depth and a ratio between the heat-transfer coefficient of various grooved tubes and a smooth tube.

FIG. 2 is a graph showing the relationship between groove depth and heat-transfer coefficient multiplier for various mass velocities ($G_x$) of the condensing refrigerant. Curve A of FIG. 2 shows the effect of groove depth as reported in the prior art U.S. Pat. No. 4,044,797 from the minimum depth to the maximum depth taught by the prior art. The mass velocity of the fluid in the prior art is 30,300 $lb_m/hr\text{-}ft^2$ Curve B of FIG. 2 shows the heat-transfer coefficient multiplier of a grooved tube in accordance with the present invention having a mass flow velocity of 200,000 $lb_m/hr\text{-}ft^2$ wherein the average heat-transfer coefficient multiplier for a tube having 0.0006–0.0012 inch grooves was significantly higher than that for smooth tubes. Curve C of FIG. 2 shows the heat-transfer coefficient multiplier for a tube of the present invention at a mass velocity of 500,000 $lb_m/hr\text{-}ft^2$ wherein the average heat-transfer coefficient multiplier for tubes having 0.0006–0.0012 inch grooves was higher than that for smooth tubes and also higher than at the lower mass velocities. Further, Curves B and C show similar increases in the heat-transfer coefficient multiplier down to a groove depth of 0.0006 inches.

Figure 3:
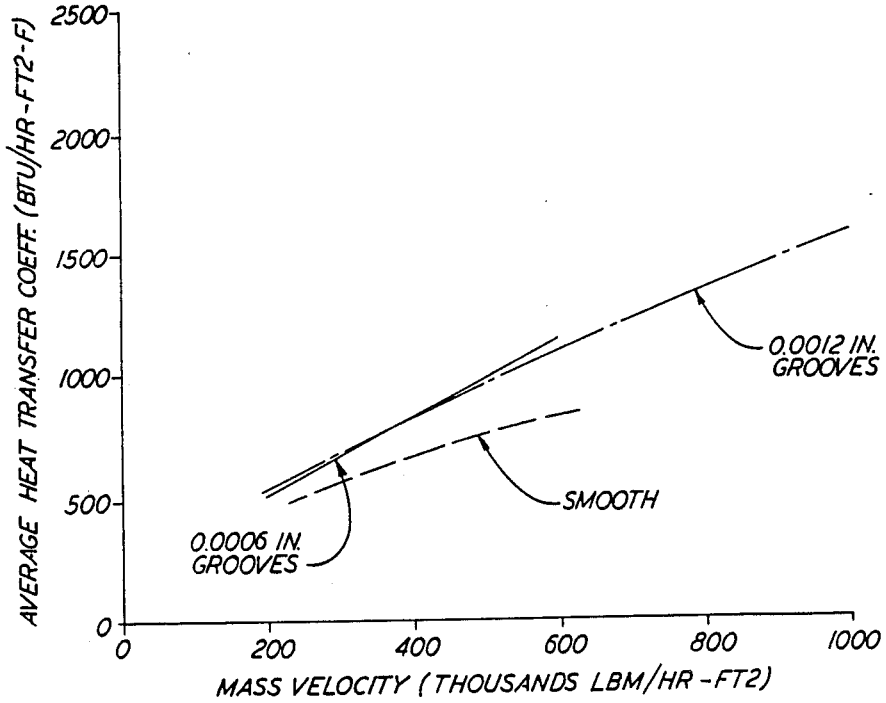
FIG. 3 is a graph showing the relationship between mass velocity flowing through tubes and the average heat-transfer coefficient of the respective tubes.

Referring now to FIG. 3, it can be seen that at a mass velocity of 200,000 $lb_m/hr\text{-}ft^2$ for tubes having a groove depth of 0.0012 inches the average condensing heat-transfer coefficient was 18% higher than that for smooth tubes. Also, it can be seen for the same tube that at a mass velocity of 500,000 $lb_m/hr\text{-}ft^2$ the average condensing coefficient was 29% higher than that for smooth tubes.

Average heat transfer coefficients for condensing tubes having fine internal grooves according to the present invention can be increased significantly in comparison to smooth tubes;

EXAMPLE 1

Material of tube; copper
Depth of groove: 0.0006 inches
Helix angle: 15°
Fin starts: 45
Area enhancement; 1.06
Increase in condensing coefficient; 12–31%

EXAMPLE 2

Material of tube; copper
Groove depth: 0.0012 inches
Helix angle: 15°
Fin starts: 50
Area enhancement; 1.09
Increase in condensing coefficient: 18.29%

The herein described invention teaches the use of condensing tubes having fine internal grooves not exceeding 0.0012 inches in depth having a refrigerant flow rate greater than 200,000 $lb_m/hr\text{-}ft^2$ wherein an unexpectedly large increase in performance of the condensing tubes is found.

What is claimed is:

1. In a direct expansion vapor compression refrigeration system including a compressor, a condenser, an evaporator, and refrigerant, said condenser having at least one metal heat-transfer member having at least one enhanced condensing surface which is adapted to be exposed to said refrigerant in a condensing state, said enhanced condensing surface being formed with grooves having a depth not exceeding 0.0012 inches, wherein said compressor causes said condensing refrigerant to flow across said enhanced condensing surface at a mass velocity equal to or greater than 200,000 $lb/_m/hr\text{-}ft^2$.

2. In a direct expansion vapor compression refrigeration system including a compressor, a condenser, an evaporator, and refrigerant, said condenser having at least one heat-transfer tube for transferring heat between said refrigerant in a condensing state flowing through the tube and a cooling fluid in contact with the exterior surface, the improvement comprising:

a plurality of fine grooves formed on the interior surface of the tube, said grooves having a depth not exceeding 0.0012 inches, wherein said compressor causes the refrigerant to flow in the tube at a mass velocity equal to or greater than 200,00 $lb_m/hr\text{-}ft^2$.

* * * * *